US006190043B1

(12) United States Patent
Diplock

(10) Patent No.: US 6,190,043 B1
(45) Date of Patent: Feb. 20, 2001

(54) FRONT OPENING PLASTIC SECURE PACKAGE WITH FALSE PANEL

(76) Inventor: Jonathan Diplock, 209 Elizabeth Ave., Westfield, NJ (US) 07090

( * ) Notice: Under 35 U.S.C. 154(b), the term of this patent shall be extended for 0 days.

(21) Appl. No.: 09/447,475

(22) Filed: Nov. 23, 1999

(51) Int. Cl.[7] ..... B65D 33/34
(52) U.S. Cl. ..... 383/5; 383/66; 383/78
(58) Field of Search ..... 383/5, 66, 78

(56) References Cited

U.S. PATENT DOCUMENTS

| | | | | |
|---|---|---|---|---|
| 1,211,367 | | 1/1917 | Gargano . | |
| 3,942,713 | | 3/1976 | Olson et al. . | |
| 5,108,194 | * | 4/1992 | Raden | 383/5 |
| 5,908,243 | * | 6/1999 | Hanning | 383/5 |

FOREIGN PATENT DOCUMENTS

| | | | | |
|---|---|---|---|---|
| 0134129 | | 3/1985 | (EP) . | |
| 0259068 | | 3/1988 | (EP) . | |
| 0341699 | | 11/1989 | (EP) . | |
| 0373748 | | 6/1990 | (EP) . | |
| 0 396 428 | * | 11/1990 | (EP) | 383/5 |
| 2 681 581 | * | 3/1993 | (FR) | 383/5 |
| 2 265 883 | * | 10/1993 | (GB) | 383/5 |
| WO 91/15406 | * | 10/1991 | (WO) | 383/5 |
| WO 93/00269 | * | 1/1993 | (WO) | 383/5 |

* cited by examiner

*Primary Examiner*—Jes F. Pascua
(74) *Attorney, Agent, or Firm*—Edward Dreyfus

(57) ABSTRACT

A plastic front opening security envelope having a slot opening in the front panel and a tamper evident tape closure that seals along the slot opening after contents are placed through the slot into the envelope interior. The envelope includes an inner false or intermediate panel section secured to one or both panels above the slot which false panel extends below the slot. In the event the envelope is closed such that the slot is spread open when sealed, the tamper tape adhesive seals through the slot to the false panel instead of the rear panel. This arrangement prevents false tripping of the tamper tape by shifting contents or other outward forces exerted on the back panel relative to the front panel or tamper tape.

16 Claims, 6 Drawing Sheets

FRONT OPENING PLASTIC SECURE PACKAGE WITH FALSE PANEL

BACKGROUND

The present invention relates to plastic secure packages and more particularly to such packages for having and conveying valuable documents and items and that have tamper evident closures. As used herein, package, envelope, bag and container shall mean equivalent structures.

There are many types of plastic security envelopes with tamper evident features. One common type is shown in FIG. 6 and includes a plastic envelope having a rear panel 100 a front panel 102. These panels could be joined at the bottom by heat seals or adhesives or formed from a single sheet folded back on itself at the bottom 101 as shown in FIG. 6. Side seals, not shown, are formed along both side-edge regions by applying adhesives or hot sealing the internal panel edges together. The upper ends of panels 100 and 102 are joined at 104 by a heat seal extending the width of the bag or by suitable hot melt adhesive as desired. An optional tear off receipt 106, suitably numbered, can be attached to one of the panels via weakened perforations 105.

A generally horizontal slit 108 is formed in front panel 102 to enable the user to introduce documents or items into the chamber of the envelope. A tamper evident sealing member 110 is provided to close and seal slit 108 and provide evidence of any tampering such as using cold dry ice or freon gas or hair dryer heat or clear adhesive tape reinforcement to remove a portion of member 110 to gain access to the housed documents or to give tamper evidency if stress forces are applied to member 110. Common and commercially available member 110 includes a tamper evident tape 116 with hot melt adhesive layer 114 one portion of which is secured to the front panel outer surface contiguous to slit 108. Conventionally, layer 114 can include imbedded graphics such as the word "void" that would appear in response to various stresses or temperatures used for tampering. The remainder of layer 114 is initially protected by a removable paper or plastic liner 112 that prevents premature or unwanted adhesive contact with the panel or any other thing. After the documents and/or items are inserted into the envelope, liner 112 is removed and member tamper evident tape 116 pressed to close and seal across slit 108. Tape 116 functions to give a special visual indication, such as multiple appearances of the word "VOID" or other graphics, if the tape had been subjected to one of several types of tampering or, alternatively, tape 116 may be designed to tear or flake or crack or shrivel to give a visual tamper indication. Various materials are commonly known to provide the above functions.

Although this type of envelope performs with some degree of reliability a technical problem exists because of a common human error in usage. Users of this type of secure package tend to be less than careful in assuring that slit 108 is substantially closed when pressing layer 116 to its closed and sealed position. Sometimes the thickness of the stack of documents or the thickness of items within the envelope cause lips 109, 111 defining slit 108 to separate. Sometimes the user pulls panel portion 109 outward when removing liner 112, then quickly applies layer 114 to the portion 111 of panel 102. On occasion, the user pulls up on the top of the bag with one hand, while releasing the liner and pressing 116 with the other hand. In any case, when improperly closed and sealed the central portion of layer 114 is exposed through the widened slot 108 and when pressure is subsequently applied to tamper tape layer 116 a portion of the inner surface of panel 100 adheres to layer 114, generally as shown in FIG. 7. Thereafter, transport or handling of the envelope on occasion causes the housed documents or items to shift in the direction of arrow A which tends to separate panel 100 from layer 114 in the general direction of arrow B, which in turn stresses layer 114 causing the tape to display, erroneously, a tampering attempt indication. This false tampering indication is costly and time consuming for the users and for the customers whose documents or items are being transported because the receiving entity, such as a bank, will not accept the bag showing tamper evidence and will return it to the sender, such as a department store, for re-packaging and shipment.

SUMMARY OF EXEMPLARY EMBODIMENT OF PRESENT INVENTION

It is an object of the present invention to provide a plastic security envelope of the type described that avoids the aforementioned problems, prevents or greatly reduces the chances for an erroneous tamper indication for the reasons described, enhances the reliability of envelopes of the type described without adding significantly to the cost or processes of manufacturing such envelopes.

According to the principles of the present invention, one exemplary embodiment includes an envelope of the type described that includes a false or intermediate panel piece secured preferably above the slot and inside the envelope between the front and back panels which piece extends preferably downward across the zone of the slot. If the bag is properly closed and sealed by the tamper tape with the lips of the slot essentially touching or contiguous, the false panel simply remains unsecured and provides neither positive nor negative function or effect to the envelope. However, if the tamper tape is closed and sealed across the slot and the slot lips are improperly spaced apart, then when pressure is applied to the tamper tape, the false internal panel adheres to the internal surface of the adhesive layer. Thereafter, unlike the prior art, any outward forces imparted to the rear panel by shifting contents or otherwise are taken up by the top and side seals and the false intermediate panel remains unstressed against the tamper tape adhesive and false tamper indications are avoided.

DRAWINGS

These and others objects, aspects, and benefits afforded by the principles of the present invention will be understood from the following detailed description of exemplary embodiments of the present invention when taken in view of the drawing, in which:

FIG. 1 is a partial perspective view of one exemplary embodiment according to the principles of the present invention with parts broken away. Note common reference numerals refer to elements common with FIGS. 6 and 7. The envelope of FIG. 1 is in its manufactured but unused condition.

DETAILED DESCRIPTION OF EXEMPLARY EMBODIMENT

Figure 1:
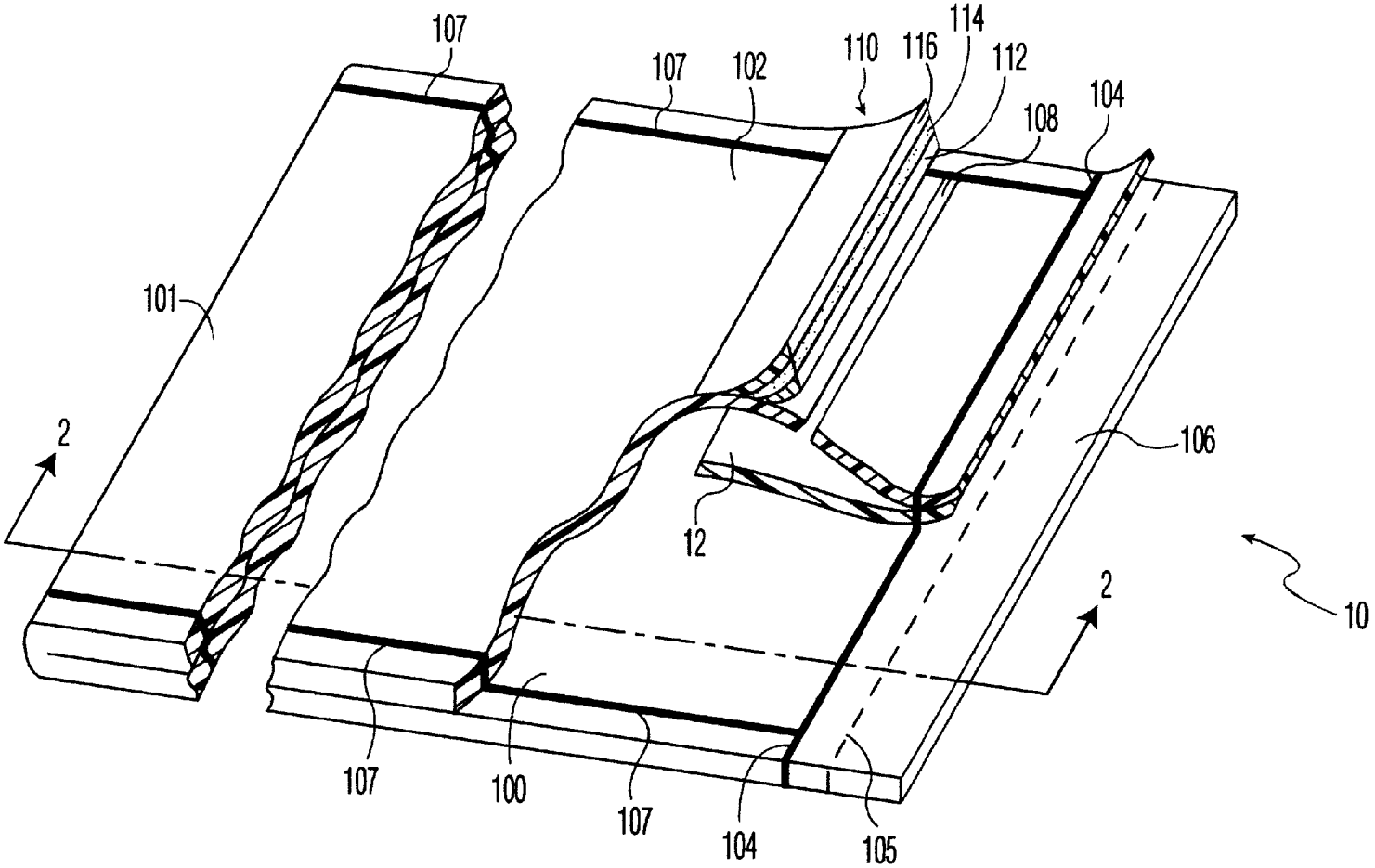
Figure 2:
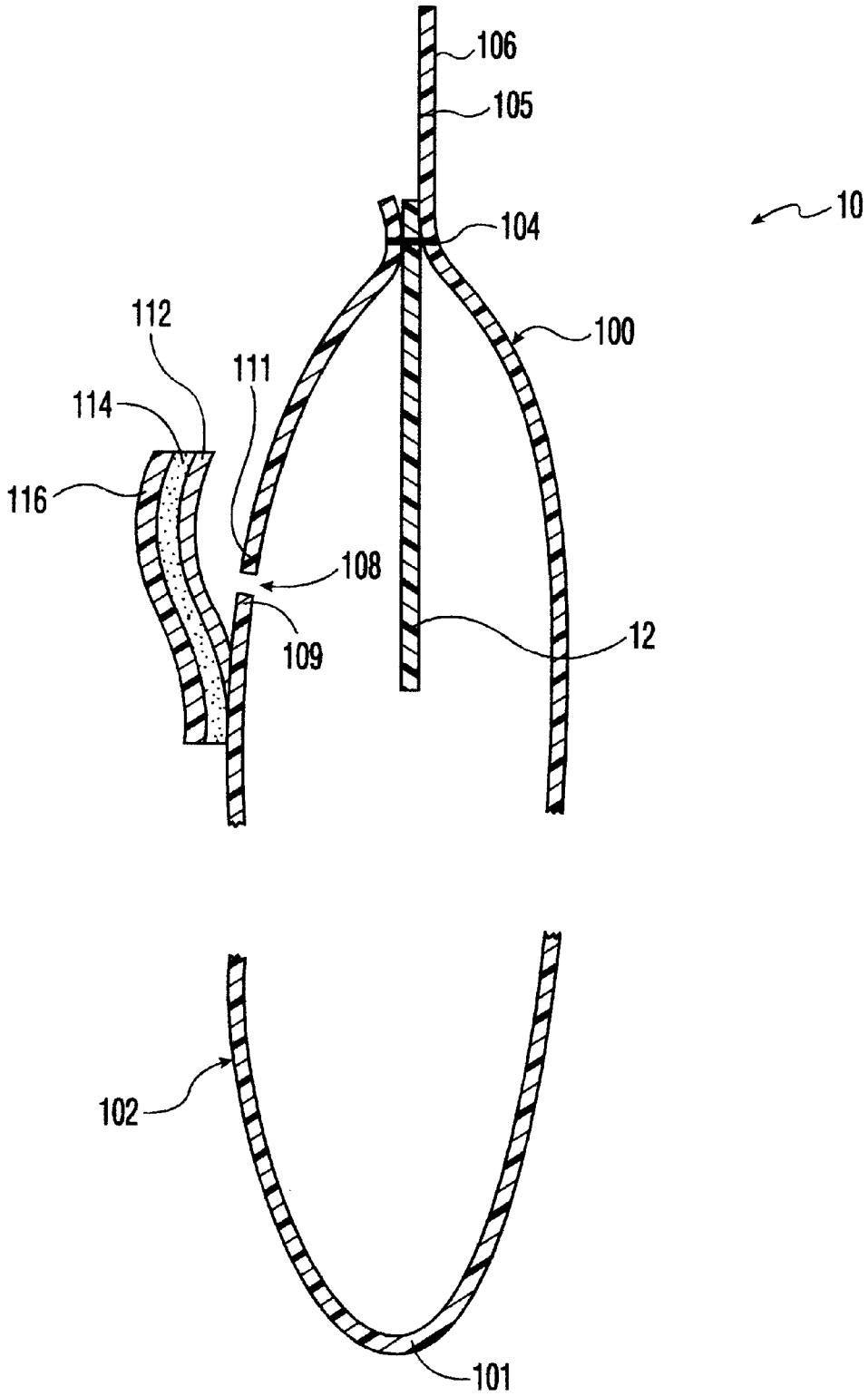
FIG. 2 is a side sectional view taken along line 2—2 of FIG. 1.
Figure 3:
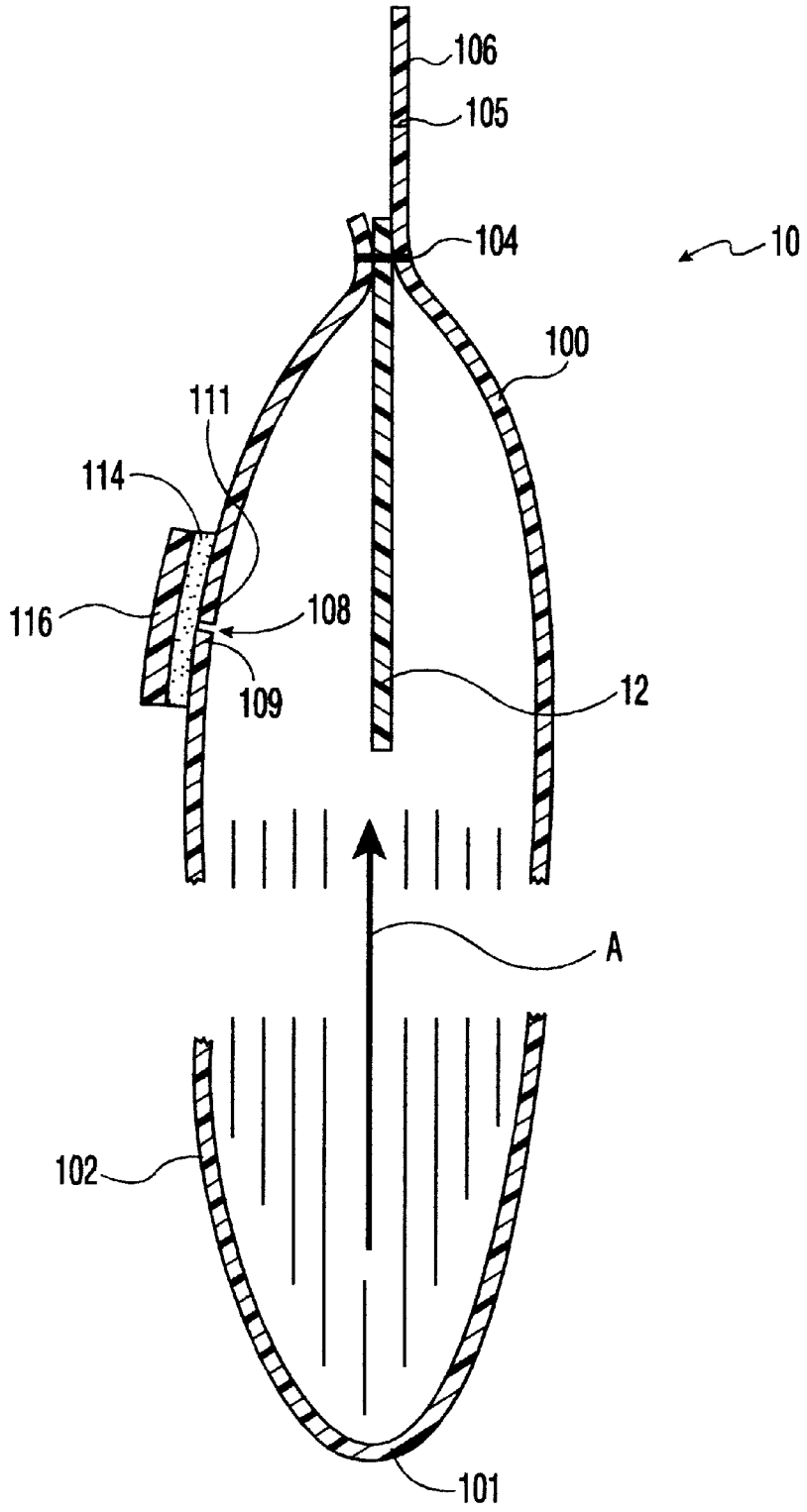
FIG. 3 is similar to FIG. 2 after the envelope has been properly closed and sealed.

With reference to FIGS. 1–4, unlike the prior art, envelope 10 includes false or intermediate internal panel 12 with its upper edge portion secured between panels 100, 102 by heat seal 104. The side edges of panel 12 are, in this example, secured between the panels by the side heat seals 107 or, if desired, the side edges of panel 12 can be contiguous but not secured by the side seals. In any event, Panel 12 should run at least the lateral extent of slot 108. Panel 12 extends toward the bottom of envelope 10 at least to a predetermined distance below slot 108 that assures the function described below. Member 110 can be located generally as shown but can alternately be initially secured above slot 108 instead of below it.

During proper operation envelope 10 is laid on a flat surface, contents are placed into the envelope through slot 108. Liner 112 is removed and with slot 108 essentially closed by lips 109, 111, tamper tape 116 is pressed to the closed, sealed position shown in FIG. 3. Since adhesive layer 114 is essentially unexposed through slot 108, panel 12 simply lies loosely between panels 100, 102. Panel 12 had not nor will not interfere with the normal placing of contents within the bag nor the movement of contents within the bag after closure.

Figure 4:
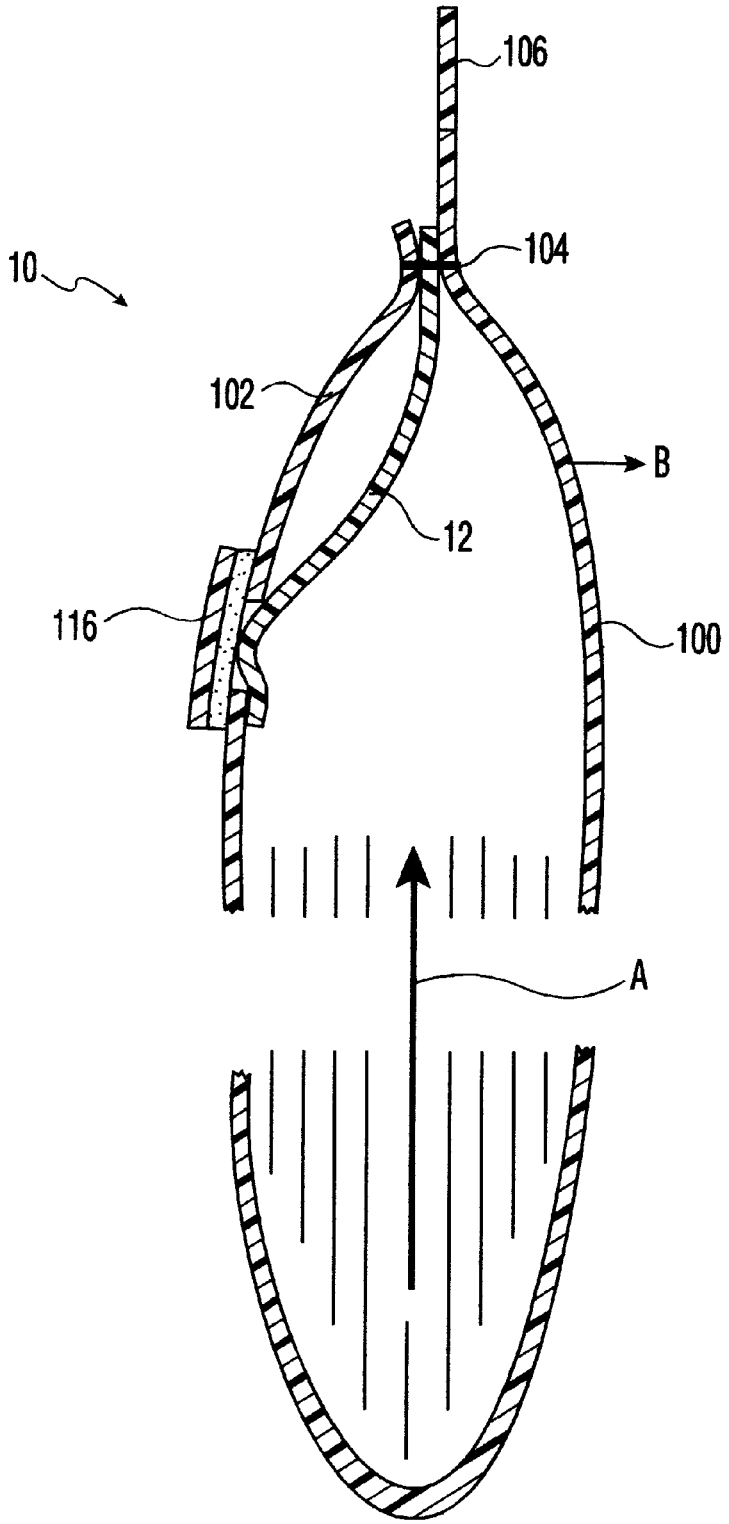
FIG. 4 is similar to FIG. 2 after the envelope has been improperly closed and sealed.

In the event envelope 10 is improperly closed with lips 109, 111 spread apart, liner 112 removed, tamper tape member 110 pressed closed and sealed, then panel 12 will adhere to layer 114 generally as shown in FIG. 4. In this condition, contents shifting to the top of envelope 10 slide past panel 12 and apply stress forces on heat seal 104 instead of layer 114. Thus, false tamper indications are avoided. Outward forces, such as arrow B, applied to panel 100 in FIG. 4 are also taken up by seal 104 and the side seals 107 rather than layer 114 and tape 116.

Figure 5:
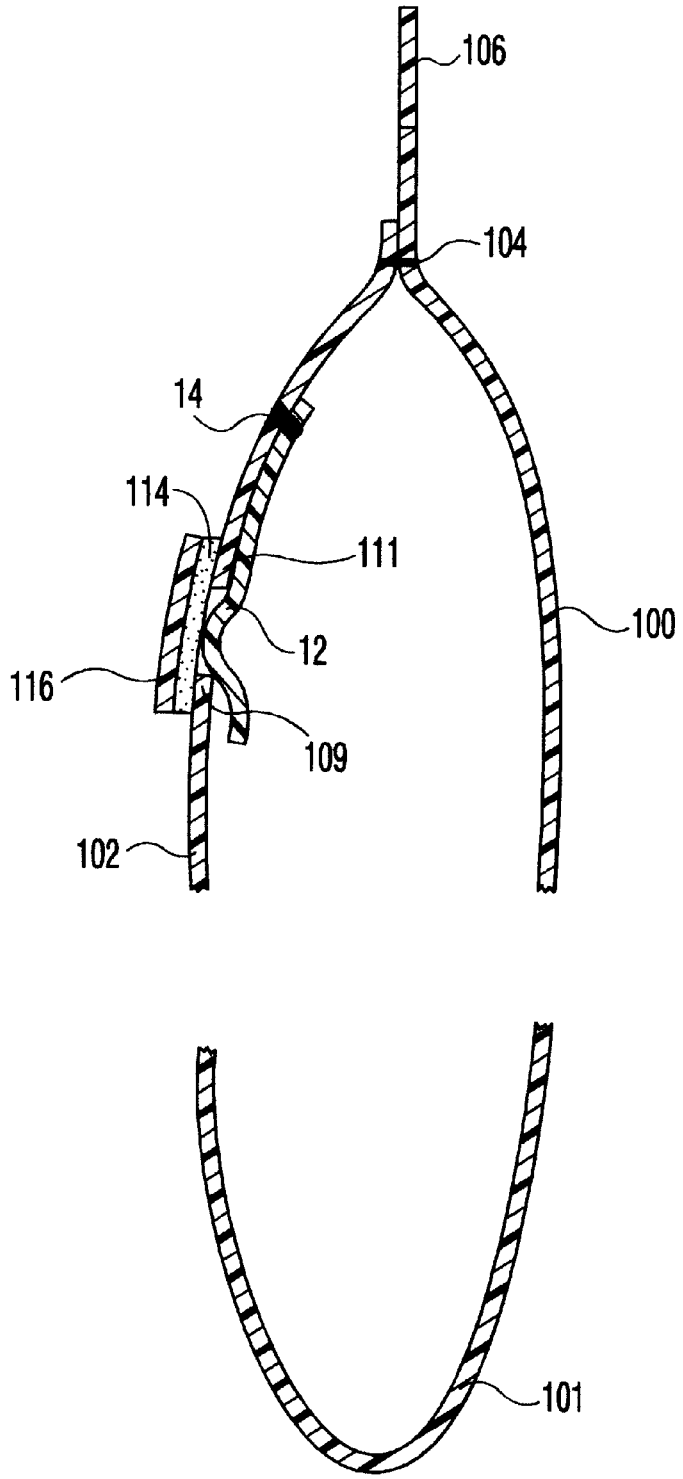
FIG. 5 is similar to FIG. 4 showing an alternate embodiment of the present invention.
Figure 6:
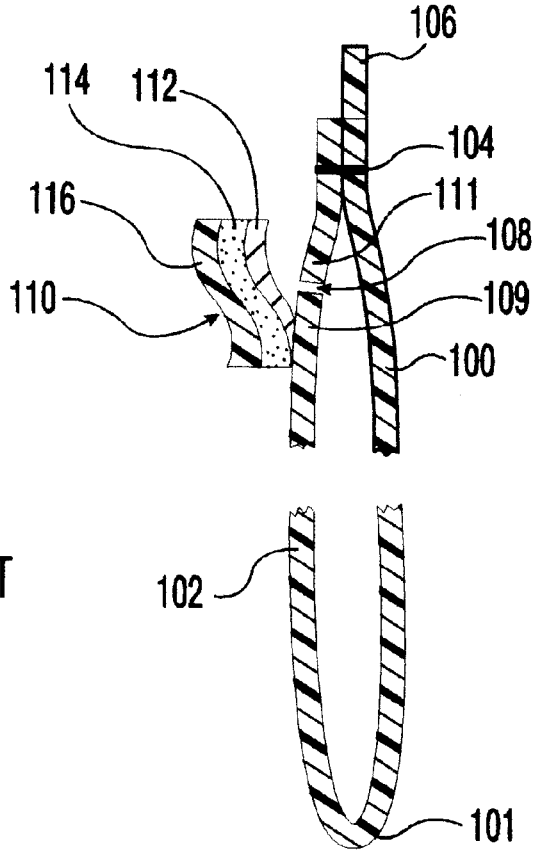
FIG. 6 PRIOR ART
FIG. 6 is similar to FIG. 2 showing a conventional prior art embodiment.
Figure 7:
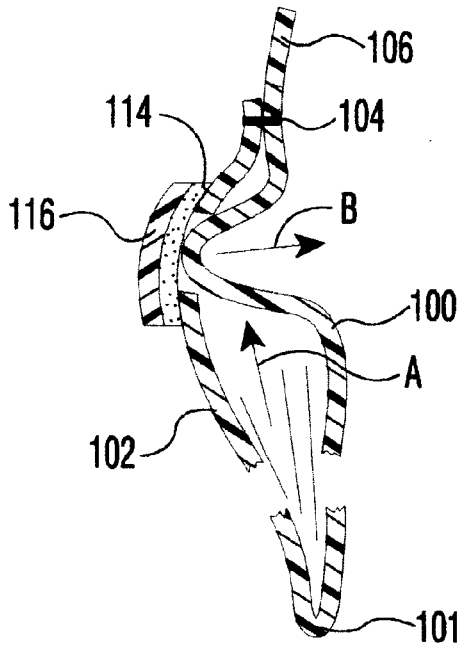
FIG. 7 PRIOR ART
FIG. 7 is similar to FIG. 6 after the prior art envelope has been improperly closed and sealed.

With reference to FIG. 5, an alternate position of panel 12 is to secure, for example, its top edge to the inside of the rear panel 102 somewhat above slot 108 by an additional adhesive or heat seal strip 14, as desired. Panel 12 in this alternative embodiment also will not affect content loading or movement after closure.

It will be apparent that none of the figures are necessarily drawn to scale. Other and further modification, enhancements, and changes can be made to the herein disclosed embodiments without departing from the spirit and scope of the present invention. The selection of materials can be standard and are well known in the art.

What is claimed is:

1. A plastic front opening security envelope having a front panel with lips defining a slot opening in the front panel, a tamper evident tape member secured to the outer surface of said front panel and having an adhesive layer for sealing said member to said lips to close and seal said slot opening, an inner false panel member located within the envelope and extending across said lips wherein said false panel seals to said adhesive layer through said slot opening in the event said lips are separated when said member is closed and sealed to said front panel lips, said false panel including an upper portion secured to at least one of said front and rear panels, and wherein said upper portion is secured to said front panel.

2. An envelope as set forth in claim 1, wherein said upper portion is secured to said front panel between the top of said front panel and said slot.

3. An envelope as set forth in claim 1, wherein said envelope includes a side seal along each longitudinal edge of envelope sealing the front and back panels therealong.

4. An envelope as set forth in claim 3, wherein the side edges of said false panel are secured to said front and back panels by said side seals.

5. An envelope as set forth in claim 3, wherein said lips defining said slot extend from substantially one side seal to substantially the other side seal.

6. An envelope as set forth in claim 5, wherein said false panel extends the full operatable length of said lips defining the slot.

7. An envelope as set forth in claim 1, wherein said tape member includes a liner releasably secured to said adhesive layer.

8. An envelope as set forth in claim 1, wherein said tape member comprises an embedded graphics security tape.

9. A plastic front opening security envelope having a front panel with lips defining a slot opening in the front panel, a tamper evident tape member secured to the outer surface of said front panel and having an adhesive layer for sealing said member to said lips to close and seal said slot opening, an inner false panel member located within the envelope and extending across said lips wherein said false panel seals to said adhesive laver through said slot opening in the event said lips are separated when said member is closed and sealed to said front panel lips, said false panel including an upper portion secured to at least one of said front and rear panels, and wherein said upper portion is secured to both said front and rear panels.

10. An envelope as set forth in claim 9, wherein said upper portion is secured sandwiched between said front and rear panels.

11. An envelope as set forth in claim 9, wherein said envelope includes a side seal along each longitudinal edge of envelope sealing the front and back panels therealong.

12. An envelope as set forth in claim 11, wherein the side edges of said false panel are secured to said front and back panels by said side seals.

13. An envelope as set forth in claim 11, wherein said lips defining said slot extend from substantially one side seal to substantially the other side seal.

14. An envelope as set forth in claim 13, wherein said false panel extends the full operatable length of said lips defining the slot.

15. An envelope as set forth in claim 9, wherein said tape member includes a liner releasably secured to said adhesive layer.

16. An envelope as set forth in claim 9, wherein said tape member comprises an embedded graphics security tape.

* * * * *